US007322420B2

(12) United States Patent
Trinder et al.

(10) Patent No.: US 7,322,420 B2
(45) Date of Patent: Jan. 29, 2008

(54) TUBING EXPANSION

(75) Inventors: Duncan James Trinder, Inverurie (GB); Neil Andrew Abercrombie Simpson, Aberdeen (GB); John Strachan Nicoll, Ellon (GB); Graham MacKay, Aberdeen (GB); Alexander Craig MacKay, Banchory (GB)

(73) Assignee: Weatherford/Lamb, Inc., Houston, TX (US)

( * ) Notice: Subject to any disclaimer, the term of this patent is extended or adjusted under 35 U.S.C. 154(b) by 334 days.

(21) Appl. No.: 10/787,993

(22) Filed: Feb. 26, 2004

(65) Prior Publication Data

US 2004/0163823 A1 Aug. 26, 2004

(30) Foreign Application Priority Data

Feb. 26, 2003 (GB) ..... 0304335.3

(51) Int. Cl.
*E21B 23/00* (2006.01)

(52) U.S. Cl. ..... 166/382; 166/207

(58) Field of Classification Search ..... 166/277, 166/311, 381, 387, 207, 242.2
See application file for complete search history.

(56) References Cited

U.S. PATENT DOCUMENTS

| | | | | |
|---|---|---|---|---|
| 3,191,677 | A * | 6/1965 | Kinley | 166/277 |
| 5,562,000 | A | 10/1996 | Shultz, Sr. | |
| 5,785,120 | A * | 7/1998 | Smalley et al. | 166/55 |
| 5,983,695 | A | 11/1999 | Lutz | |
| 6,012,523 | A | 1/2000 | Campbell et al. | |
| 6,112,818 | A * | 9/2000 | Campbell | 166/384 |
| 6,352,112 | B1 * | 3/2002 | Mills | 166/277 |
| 6,454,493 | B1 | 9/2002 | Lohbeck | |
| 6,622,789 | B1 * | 9/2003 | Braddick | 166/277 |
| 6,668,930 | B2 * | 12/2003 | Hoffman | 166/298 |
| 6,712,151 | B2 | 3/2004 | Simpson et al. | |
| 6,814,143 | B2 * | 11/2004 | Braddick | 166/277 |
| 2003/0024711 | A1 * | 2/2003 | Simpson et al. | 166/384 |
| 2003/0168222 | A1 | 9/2003 | Maguire et al. | |
| 2004/0016544 | A1 * | 1/2004 | Braddick | 166/277 |
| 2004/0094312 | A1 | 5/2004 | Lohbeck et al. | |
| 2004/0177953 | A1 * | 9/2004 | Wubben | 166/207 |
| 2005/0022986 | A1 * | 2/2005 | Ring et al. | 166/208 |
| 2005/0045342 | A1 * | 3/2005 | Luke et al. | 166/384 |

(Continued)

FOREIGN PATENT DOCUMENTS

| | | |
|---|---|---|
| EP | 0234283 | 9/1987 |

(Continued)

OTHER PUBLICATIONS

European Patent Office Search Report, dated Jun. 11, 2003, for GB 0304335.3.

(Continued)

*Primary Examiner*—Frank Tsay
(74) *Attorney, Agent, or Firm*—Patterson & Sheridan, LLP

(57) ABSTRACT

An apparatus and a method for expanding a downhole tubular. The apparatus includes a mandrel defining at least one curved support surface. The apparatus further includes an expansion member defining a curved bearing surface for contact with the support surface and corresponding to the mandrel support surface. The expansion member is movable relative to the mandrel, whereby the surfaces are in contact and movable over one another to move the expansion member from a smaller diameter first configuration towards a larger diameter second configuration.

93 Claims, 3 Drawing Sheets

Open and Moving Position

U.S. PATENT DOCUMENTS

2005/0103502 A1* 5/2005 Watson et al. ..... 166/380

FOREIGN PATENT DOCUMENTS

| | | | |
|---|---|---|---|
| EP | 1306519 | | 5/2003 |
| FR | 2305251 | | 10/1976 |
| GB | 1 485 099 | A | 9/1977 |
| GB | 2 236 066 | A | 3/1991 |
| WO | WO 9935368 | A1 * | 7/1999 |
| WO | WO 84/00120 | | 1/2000 |
| WO | WO 01118354 | A1 * | 3/2001 |
| WO | WO 03/106130 | | 12/2003 |
| WO | WO 2004/015241 | | 2/2004 |

OTHER PUBLICATIONS

U.K. Search Report, Application No. GB0404233.9, dated May 26, 2004.

GB Further Search Report, GB0404233.9, Dated Mar. 22, 2006.

* cited by examiner

TUBING EXPANSION

CROSS-REFERENCE TO RELATED APPLICATIONS

This application claims benefit of Great Britain patent application serial number 0304335.3, filed Feb. 26, 2003, which is herein incorporated by reference.

BACKGROUND OF THE INVENTION

1. Field of the Invention

This invention relates to tubing expansion, and in particular to the expansion of downhole tubing, and to tools and apparatus for use in expanding downhole tubing.

2. Description of the Related Art

A recent significant development in the oil and gas exploration and production industry has been the introduction of expandable downhole tubing, that is bore-lining tubing that is run into a drilled bore and then expanded to a larger diameter. This has permitted the creation of monobore or near monobore wells, that is wells having a substantially constant diameter. This may be achieved by running a tubular through existing bore-lining casing and into a section of open or unlined bore below the casing, but with the upper end of the new tubular overlapping the lower end of the existing casing. The tubular is then expanded to the same internal diameter as the existing casing.

The new tubular is normally hung off the lower end of the existing casing, and to achieve pressure integrity it is also necessary that a seal is created between the overlapping ends of the casing and the tubular. Furthermore, the annulus between the tubular and the wall of the bore is normally filled and sealed with cement. Numerous proposals have been put forward for apparatus and methods for implementing this complex procedure, however difficulties remain in achieving a satisfactory solution to a number of problems, in particular in hanging the tubular off the casing, cementing the tubular, and sealing the tubular to the casing.

Many of the principles utilized in the creation of a monobore and near monobore well have also been proposed for use in selected aspects of other, more conventional forms of well completion. For example, the use of expandable liner sections has been proposed to replace conventional liner hangers, where an upper end of a liner section is expanded to create a fluid-tight hanging support from the lower end of existing casing. However, the difficulties relating to providing adequate hanging support, sealing and cementing remain.

The applicant has addressed a number of these difficulties in its earlier UK Patent Application GB0210256.4, the disclosure of which is incorporated herein by reference. This application describes provision of a tubular, in particular a liner, having a profiled section which is initially located below the lower end of the casing. The profiled liner section is expanded to an external diameter slightly larger than the internal diameter of the casing and the liner is then pulled back to locate the expanded profiled section within the lower end of the casing. The expanded profiled section and the casing interact, primarily by elastic deformation of the expanded profiled section, to create a temporary hanger. The profiling of the liner section is such that fluid may pass between the overlapping sections of the liner and casing, facilitating cementing the liner. The liner may then be further expanded to create a fluid-tight seal and permanent hanging support.

Certain embodiments of the present invention relate to apparatus for use in similar operations. One embodiment of the invention relates to creation of a temporary hanger in a similar manner to that described in GB0210256.4, and further expanding the remainder of the liner below the hanger.

SUMMARY OF THE INVENTION

According to a first aspect of the present invention there is provided a tubing expansion tool, the tool comprising:

a mandrel defining at least one arcuate support surface having a radius of curvature; and at least one expansion member defining an arcuate bearing surface for contact with the support surface and having a radius of curvature corresponding to the radius of curvature of the mandrel support surface, the member being movable relative to the mandrel whereby the surfaces are in contact and movable over one another to move the expansion member from a smaller diameter first configuration towards a larger diameter second configuration.

In aspects of the invention the objects of the invention may be realized by provision of curved contacting surfaces which are not necessarily arcuate or of constant radii. However, the provision of contacting surfaces of corresponding radii ensure that the area of contact between the surfaces remains relatively large between the first and second configurations. This is particularly useful where the expansion member is intended to expand tubing as the member moves from the first configuration to the second configuration, and thus experiences an expansion load at intermediate configurations in addition to the maximum diameter second configuration. This is in contrast to arrangements in which cooperating support and bearing surfaces define straight surfaces, for example corresponding conical surfaces where, while a relatively large area contact may be achieved at the largest diameter configuration, at intermediate configurations the bearing surface would only be supported at its ends, and thus the loaded expansion member would experience elevated bending stresses, making failure more likely. With preferred embodiments of the present invention, the expansion member will only experience compression, as the member is supported over at least a significant portion of its length, and thus will be able to withstand and exert far greater expansion forces.

The enhanced ability of the tool to accommodate expansion loads at intermediate configurations provides a number of significant advantages, one being that the tool may be run into a bore in a smaller diameter configuration and accommodated within smaller diameter tubing, and indeed may be accommodated within the tubing which the tool is intended to expand. This contrasts with comparable conventional tools, which must be accommodated within an upset section of tubing, larger than the diameter of the tubing to be expanded, or even outside the tubing, thus limiting the minimum diameter of restriction which a tool string incorporating the tool may pass through. Thus, aspects of the invention also relates to an assembly in which the tool is located within tubing to be expanded, and to a method of expanding tubing from a first diameter to a second diameter in which at least an initial expansion of the tubing is achieved by moving an expansion member from a first configuration to a second configuration within the tubing. Of course in other aspects of the invention the expansion member may be moved from the first configuration to a second configuration externally of tubing to be expanded, and then subsequently located in the tubing to be expanded.

Preferably, the support surface is convex and the bearing surface is concave, although in alternative embodiments the support surface may be concave and the bearing surface convex. Most preferably, the convex support surface is arranged such that the radial extent of the surface relative to the mandrel axis varies axially along the mandrel. Alternatively, or in addition, the radial extent of the support surface may vary circumferentially, such that relative rotation of the mandrel and expansion member moves the expansion member towards the larger diameter second configuration.

Preferably, the mandrel defines a plurality of support surfaces, and a corresponding number of expansion members are provided, each defining a respective bearing surface. Most preferably, the support surfaces are positioned circumferentially around the mandrel, and may be tangential to the mandrel. Most preferably the support surfaces are of corresponding circumferential extent and are continuous around the circumference of the mandrel such that, in section, the mandrel has the appearance of a regular polygon.

Preferably, a plurality of expansion members are provided and in the second configuration collectively define an expansion cone, that is each expansion member defines a cone segment. Most preferably, the cone segments interlock or overlap to define a substantially continuous circumference in the larger diameter second configuration.

Preferably, the expansion member is adapted to rock or pivot relative to the mandrel as the member moves from the first configuration to the second configuration, that is as the bearing surface moves along the support surface.

Preferably, at least one end of the expansion member is radially restrained relative to the mandrel, for example a mounting ring may be provided around the mandrel and the end of the member located in the ring. The other end of the expansion member may also be restrained by a further restraining member, to prevent or restrict the member from moving beyond the second configuration.

Preferably, the tool comprises at least one stop for preventing movement of the expansion member beyond the second configuration. A stop may be provided on the mandrel, for limiting axial movement of the expansion member. The stop may be movable from an initial at least partially retracted position to an extended position, and such movement may be the result of an initial contact between the expansion member and the stop in the at least partially retracted position as the expansion member approaches the second configuration. Alternatively, or in addition, the mandrel and expansion member may define corresponding stop faces. Contact between the faces may be achieved, at least in part, from rocking or pivoting of the expansion member relative to the mandrel.

Preferably, the expansion member is movable axially relative to the mandrel, and the support surface extends axially of the mandrel. To ensure that the expansion member is moved to the second configuration before the expansion member is advance axially through the tubing to be expanded, means may be provided for initially restraining the expansion member against axial movement relative to the tubing. Such means may take any appropriate form and in a preferred embodiment involves a releasable member, such as a shear fitting, but which may take the form of a simple weld bead on an inner surface of the tubing, which weld bead is intended to be sheared off when the axial force experienced by the bead exceeds the force that it is anticipated will be sufficient to move the expansion member to the second configuration and produce a corresponding initial expansion of the tubing.

The support surface and bearing surface may initially be spaced apart, such that a significant degree of relative movement between the mandrel and the expansion member is required, or accommodated, before the expansion member begins to move towards the second configuration.

Preferably, the tool expansion tool includes a seal member adapted to form a fluid seal with surrounding tubing, and which seal member is preferably coupled to the mandrel. The seal member may be in the form of a swab cup. A pressure differential may be created across the seal member, producing a pressure force on the tool, which force may be utilized to move the mandrel relative to the expansion member, or to move the tool through the tubing. This ability to utilize fluid pressure to move the tool through the tubing allows the expansion of the tubing to take place without mechanical intervention from surface. This offers numerous advantages, one being that the tool may be separated from the associated running string during the tubing expansion process, such that, if desired, the running string may be utilized to support the tubing during the expansion process. Thus, it may not be necessary to provide a tubing hanger prior to expansion taking place. Furthermore, the mandrel support surface may itself be utilized as an expansion surface, that is a surface for contact with an inner wall of tubing to be expanded. In one embodiment, the mandrel may be axially translated through a length of tubing to expand the tubing. In a preferred embodiment, the mandrel may be used to provide an initial degree of expansion to a section of profiled tubing, such as described in applicant's GB0210256.4. The expansion member may be located directly below the section of profiled tubing such that, following expansion of the profiled section, the expansion member is moved to the second configuration and utilized to expand a lower section of tubing, which may be of conventional cylindrical form.

The presence of the seal member also allows elevated internal fluid pressure to be used to assist in the mechanical tubing expansion process achieved by the contact between the expansion member and the tubing. This assistance may be particularly useful if the reconfiguration of the expansion member takes place in concert with expansion of the tubing. A description of some of the advantages of such an expansion process may be found in applicant's earlier International Patent Application WO 02/081863, and U.S. patent application Ser. No. 10/102,543, the disclosures of which are incorporated herein by reference.

Preferably, the tool includes a leading tubing treating or conditioning portion, and most preferably the tubing treating portion is provided in combination with a seal member. Thus, the tubing treating portion may clean the tubing ahead of the seal member, for example removing scale and the like, thus facilitating formation of a seal between the seal member and the tubing, and extending seal life. Preferably, the treating portion is adapted to expand or reform the tubing to a predetermined diameter, to match the seal member, and thus assists in avoiding loss of sealing function where the tubing to be expanded is oval is dented or otherwise has an irregular form. Most preferably, the tubing treating portion is adapted to provide a compliant expansion or reforming function, that is the portion does not define a fixed diameter and is thus capable of negotiating or passing immovable restrictions. Furthermore, the tubing treating portion is preferably spaced from the expansion member when the member is in the second configuration and thus acts to stabilize the expansion member and facilitates straight and consistent expansion; in the absence of such stabilization the expansion member may tend to deviate from the tubing axis as it is translated through the bore, with the result that there is a loss of cylindricality. This feature may also be used to advantage in combination with other forms of expansion member or expansion device, and the stabilization of the expansion member may be of particular assistance in expanding tubing which is differentially stuck in a bore. In such cases, the portion of the tubing wall which is pressed against the bore wall will often experience less extension or deformation than the remainder of the wall, which may result in undesirable thinning or extension of the remainder of the wall. By stabilizing the expansion process by providing the leading conditioning or treating portion this problem may be obviated or mitigated. Without wishing to be bound by theory, it is believed the leading conditioning portion assists in lifting the tubing clear of the bore wall before expansion takes place.

Other aspects of the invention relate to methods of expanding tubing; and also to various ones of the preferred or alternative features mentioned above which have utility independently of the first aspect.

BRIEF DESCRIPTION OF THE DRAWINGS

These and other aspects of the present invention will now be described, by way of example, with reference to the accompanying drawings, in which.

DETAILED DESCRIPTION OF THE PREFERRED EMBODIMENT

Figure 1:
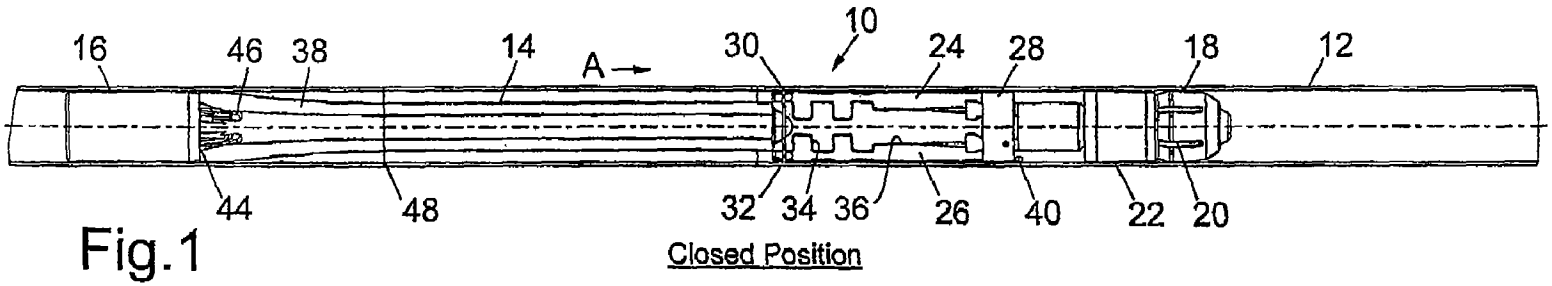
FIG. 1 is a view of a tubing expansion tool in accordance with an embodiment of the present invention, shown located in tubing to be expanded, and showing the tool in a first configuration.

Reference is first made to FIG. 1 of the drawings, which illustrates a tubing expansion tool 10 in accordance with a preferred embodiment of one aspect of the present invention. The tool 10 is shown in a closed first configuration in FIG. 1, while FIGS. 2 and 3 of the drawings show the tool 10 in an open second configuration, and being used to expand a section of downhole tubing 12. Following a description of the tool 10, with reference to FIGS. 1, 2 and 3, the use of the tool 10 in a tubing expansion operation will be described with reference to FIGS. 4 to 9 of the drawings.

The tool 10 comprises a mandrel 14 having a connector 16 at one end to allow the tool 10 to be releasably mounted at the lower end of a tool string. As will be described, the connector 16 incorporates an internal fishing profile, to allow retrieval of the tool 10 following a tubing expansion operation.

Mounted to the lower or leading end of the mandrel 14 is a compliant expansion cone 18. The cone 18 is compliant in the sense that the cone 18 is sized to induce a slight diametric expansion of the tubing 12, but if the cone 18 should encounter an immovable restriction the slots 20 in the cone 18 permit a degree of radial deflection such that the cone 18 is not stuck fast on encountering such a restriction. The function of the cone 18 is to treat and clean the inner surface of the tubing 12 as the tool 10 advances through tubing 12, as will be described, and also to ensure that the tubing 12 is of a consistent cylindrical form, that is the cone 18 will tend to remove any ovality or dents in the tubing wall.

The cone 18 thus conditions the tubing 12 to facilitate operation of a seal member, in the form of a swab cup 22, which is mounted on the mandrel 14 directly behind the cone 18. As will be described, a differential pressure across the swab cup 22 urges the tool 10 through the tubing 12 in the direction of arrow A.

Figure 2:
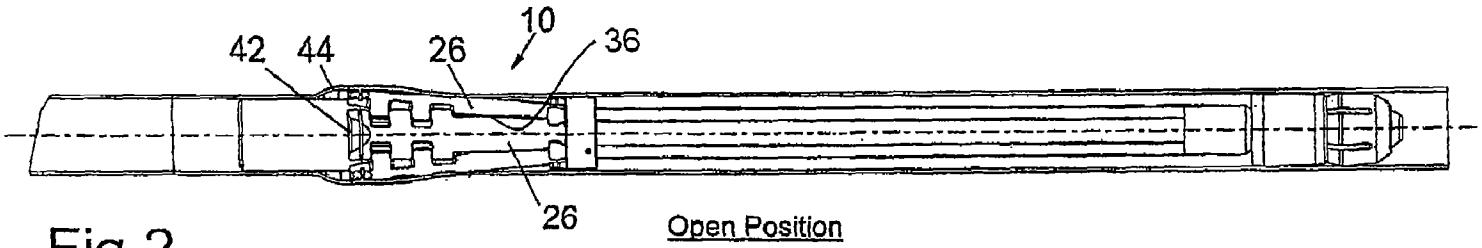
FIG. 2 is a view of the tool of FIG. 1, showing the tool in a second configuration, and showing the tubing following an initial degree of expansion.
Figure 3:
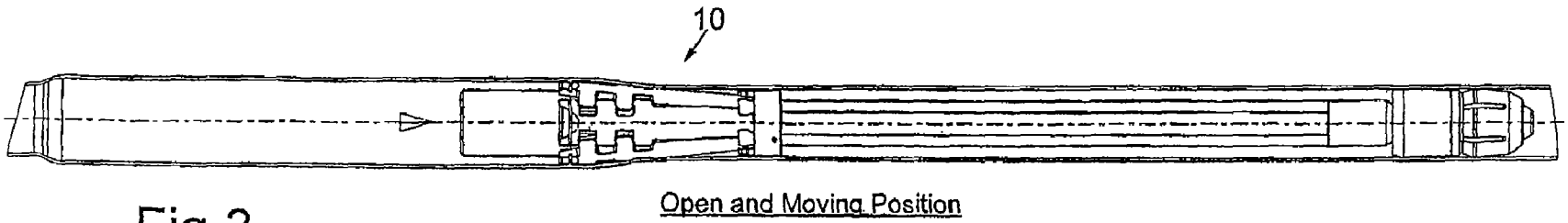
FIG. 3 is a view of the tool of FIG. 1 and showing the tool in the second configuration and moving through and expanding the tubing.

When the tool 10 is in the first or closed position, in which configuration the tool 10 is run into a bore with the tubing 12, a six segment cone 24 is located on the mandrel 14 towards the leading end of the mandrel 14, to the rear of the swab cup 22. The cone 24 comprises six expansion members or segments 26, the leading ends of which are retained relative to the mandrel 14 by a mounting ring 28. A hoop spring 30 is located in a series of circumferentially aligned slots 32 formed in the trailing ends of the segments 26 and tends to maintain the cone 24 in the closed position. The trailing ends of the segments 26 are also interlocked with one another by means of co-operating castellations 34 such that, when in the second configuration or open position as illustrated in FIGS. 2 and 3, there are no continuous axial gaps between the segments 26.

Figure 10:
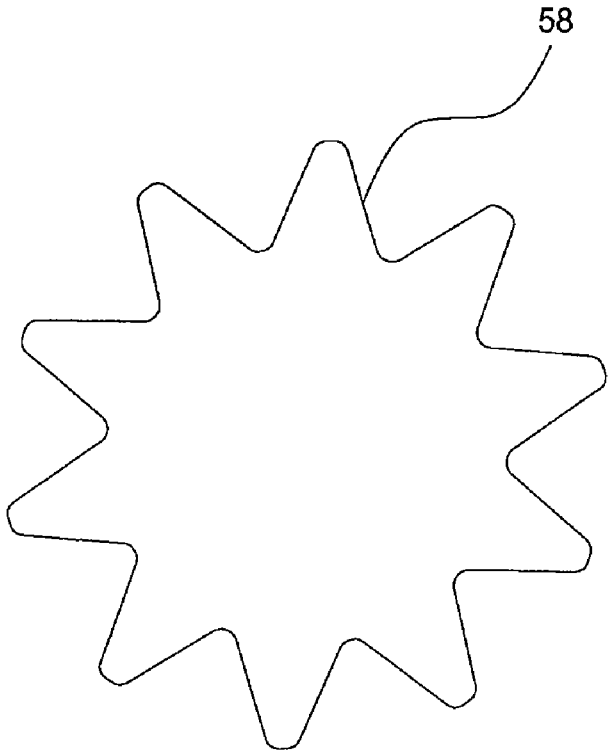

FIG. 10 is a cross-section of a tubular with a crinkled wall profiled section.

The inner face of each segment 26 defines a large radius convex arc 36 for co-operating with a respective support surface 38 defined on the outer surface of the mandrel 14. The support surface 38 defines a concave arc having the same relatively large radius of curvature as the segment bearing surface 36. As will be described, the configurations of these surfaces 36, 38 provide for a large area of support for the segments 26 as they move from the closed position to the open position.

To open the segments 26, the mandrel 14 is moved in the direction of arrow A relative to the cone 24. In use, this movement is induced by a pressure differential acting across the swab cup 22, a weld bead 40 on the tubing 12 directly in front of the mounting ring 28 ensuring that the cone 24 remains stationary relative to the tubing 12 until the cone 24 has been fully opened.

As the mandrel 14 moves through the cone 24, the segments 26 are moved axially along the concave support surfaces 38 and pushed radially outwardly. As the cone 24 in its closed position is only very slightly smaller than the inner diameter of the tubing 12, the opening of the cone 24 can only be accommodated by diametric expansion of the tubing 12, as illustrated in FIG. 2. Accordingly, the segments 26 must produce a significant expansion force, and are themselves subject to considerable loads. However, the configuration of the mandrel support surfaces 38 and the segment bearing surfaces 36 are such that the segments 26 are supported over a relatively large proportion of their lengths. The segments 26 thus experience little if any bending as the tubing 12 is expanded. Rather, the loads experienced by the segments 26 are predominantly compression loads, such that significant loads can be experienced by the segments without damage.

As the cone 24 approaches the trailing end of the mandrel 14, and the segments 26 approach the fully opened position, the end faces 42 of the segments 26 engage stops 44 which lie within recesses 46 formed in the mandrel. The floor of each recess 46 defines a ramp, such that as a stop 44 is pushed toward the trailing end of the mandrel 14 by the cone segments 26, the stops 44 ride up the recess floors to a radially extended position, as illustrated in FIG. 2. The stops 44 are T-shaped, such that the base of the stop 44 cannot pass out of the recess 46, and therefore the stops 44 prevent the segments 26 passing beyond the desired open position.

A further stop is also provided in the form of lips or ledges on the bearing and support surfaces 36, 38. A ledge 48 is formed on each support surface 38 and a ledge (not shown) is also provided towards the leading end of each bearing surface 36. As the cone 24 moves along the mandrel 14, the arcuate form of the surfaces 36, 38 is such that the segments 26 tend to pivot or rock such that the bearing surface ledges, which are initially spaced from the corresponding support surfaces, move in towards the support surfaces and as the segments 26 reach the open position the ledges engage, further acting to prevent further, undesired movement of the cone segment 26 relative to the mandrel 14.

Once the cone 24 has been opened, application of further axial force to the mandrel 14, created by the pressure differential across the swab cup 22, will cause the weld bead 40 to be sheared from the inner surface of the tubing 12, such that the open cone 18 may be advanced through the tubing 12, diametrically expanding the tubing 12, as illustrated in FIG. 3.

The use of the tool in the deployment of a solid expandable tubular will now be described, with reference to FIGS. 4 to 9 of the drawings, which illustrate such a deployment in accordance with an embodiment of a further aspect of the present invention.

Figures 4, 5, 6, 7, 8, 9:
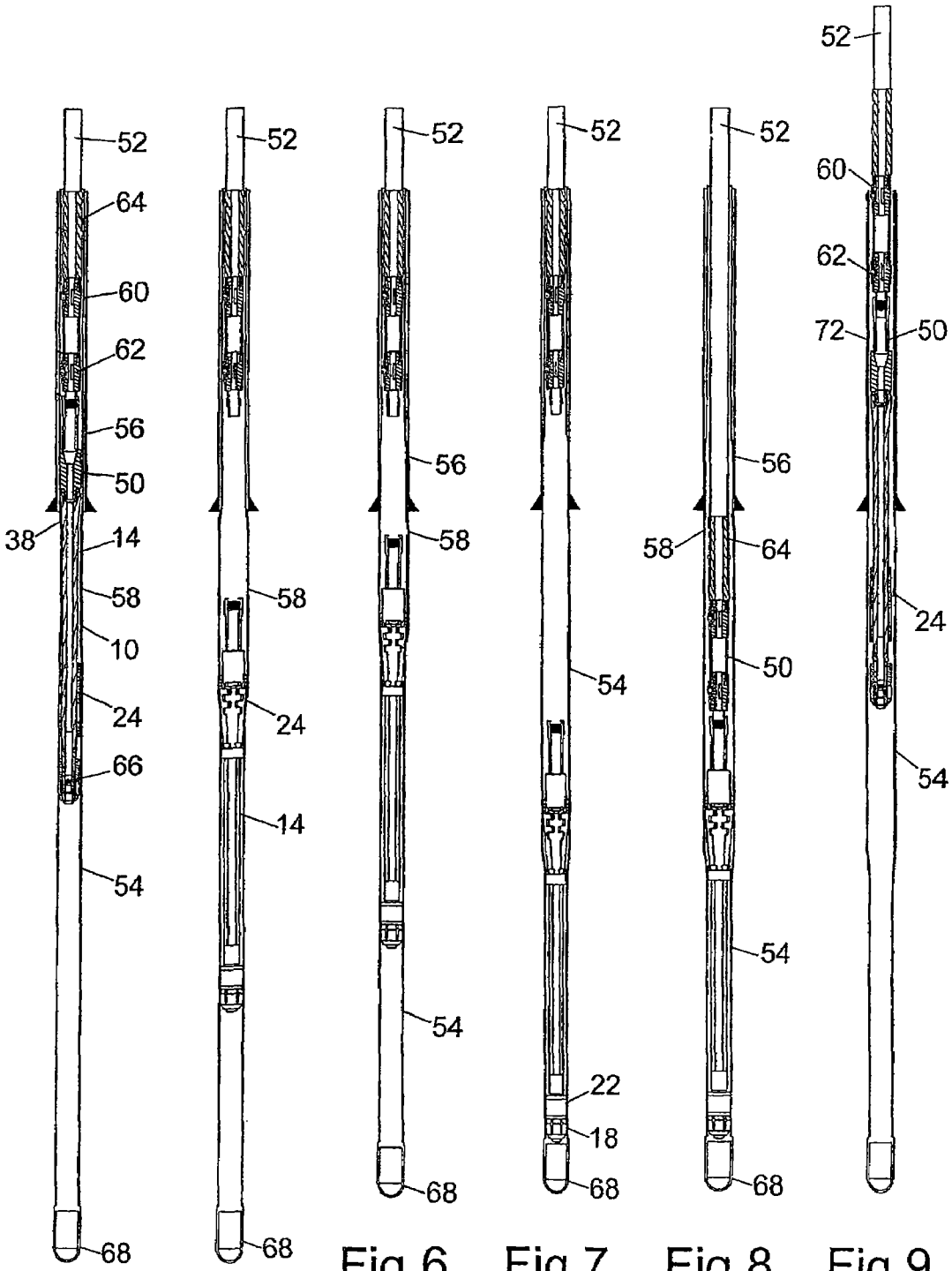
FIGS. 4, 5, 6, 7, 8 and 9 are schematic part-sectional views of sequential stages in a tubing expansion operation, utilizing the tubing expansion tool of FIG. 1.

Reference is first made to FIG. 4, which shows the tool 10 forming the leading end of a tool string 50 mounted on the lower end of a length of drill pipe 52. The tool string 50 initially supports and is located within the upper end of a section of liner 54 which is to be hung off from existing casing 56, and subsequently expanded and cemented, as will be described. The tool 10 is located within the liner 54 and straddles a profiled liner section 58. This liner section 58 has been formed to provide a corrugated or crinkled wall profile. Other than the profiled section 58, the liner 54 is of a generally cylindrical form and has an outer diameter slightly smaller than the inner diameter of the casing 56, to provide sufficient clearance for the liner 54 to be run in to the bore through the casing 56. However, the profiled liner section 58 has previously been shaped into polygonal form, in particular a hexagonal form, in a forming die, and the planar wall portions then further deformed to a concave form such that the outer diameter of the profiled liner section 58 is described by six outer vertices or corners. The minimum inner diameter of the profiled section 58 is defined by the mid-points of the concave wall portions. The unexpanded or closed cone 24 is located below the profiled section 58, and the mandrel 14 extends upwardly through the profiled section 58 with the radially outwardly extending portions of the support surfaces 38 located adjacent the upper end of the profiled liner section 58.

The tool string 50 above the tool 10 includes two fluid actuated rotary expansion tools 60, 62, such as described in applicant's WO 00/37766 the disclosure of which is incorporated herein by reference, and a running tool 64.

In the first stage of the deployment of the liner 54, the liner 54 is run into the casing 56 and into the open or unlined portion of bore below the casing 56, to the position as illustrated in FIG. 4. Elevated hydraulic pressure is then communicated through the drill pipe 52 from surface. As the central through-bore which extends through the tool string 50 is closed at the leading end of the expansion tool 10 by a ball 66, this elevated pressure acts internally of the tool string 50, which is arranged to unlatch the tool 10 from the remainder of the tool string 50 in response to the elevated pressure.

The running tool 64 provides a seal against the inner wall of the liner 54 such that the elevated hydraulic pressure which is now communicated to the interior of the upper section of the liner 54 creates a pressure differential across the swab cup 22 at the leading end of the tool 10. This tends to translate the mandrel 14 downwardly, which initially pulls the mandrel 14 downwards through the profiled liner section 58. The diameter defined by the mandrel 14, and in particular the diameter described by the support surfaces 38, is selected such that the support surfaces 38 contact and urge outwards the inner faces of the concave wall portions of the profiled section 58. This has the effect of moving the corners of the profiled section 58 radially outwards to describe an increased outer diameter, slightly larger than the internal diameter of the cemented casing 56. Subsequent translation of the mandrel 14 beyond the profiled section 58 results in expansion or opening of the cone 24, as was described with reference to FIG. 2 above. This results in expansion of the liner 54 below the profiled section 58 to a larger diameter configuration, to accommodate the expanded cone, and this is illustrated in FIG. 5. This expansion of the liner 54 is of course assisted by the elevated hydraulic pressure, which serves to reduce the mechanical expansion force which must be applied to the wall of the liner 54 by the cone as the cone itself opens or expands.

The drill pipe 52 is then lifted from surface to lift the liner 54 and pull back the expanded profiled section 58 into the lower end of the casing 56, as illustrated in FIG. 6. This requires a degree of elastic deformation of the profiled liner section 58, as the outer diameter described by the expanded section 58 must reduce to allow the section 58 to move into the substantially inelastic casing 56. This deformation of the profiled liner section 58 is substantially elastic, such that the spring force created in the section 58, tending to increase the diameter of the section 58, serves to retain the section 58 securely within the lower end of the casing 56. The section 58 thus serves as a temporary hanger for the liner 54.

Reference is first made to FIG. 4, which shows the tool 10 forming the leading end of a tool string 50 mounted on the lower end of a length of drill pipe 52. The tool string 50 initially supports and is located within the upper end of a section of liner 54 which is to be hung off from existing casing 56, and subsequently expanded and cemented, as will be described. The tool 10 is located within the liner 54 and straddles a profiled liner section 58. This liner section 58 has been formed to provide a corrugated or crinkled wall profile, as shown in FIG. 10. Other than the profiled section 58, the liner 54 is of a generally cylindrical form and has an outer diameter slightly smaller than the inner diameter of the casing 56, to provide sufficient clearance for the liner 54 to be run in to the bore through the casing 56. However, the profiled liner section 58 has previously been shaped into polygonal form, in particular a hexagonal form, in a forming die, and the planar wall portions then further deformed to a concave form such that the outer diameter of the profiled liner section 58 is described by six outer vertices or corners. The minimum inner diameter of the profiled section 58 is defined by the mid-points of the concave wall portions. The unexpanded or closed cone 24 is located below the profiled section 58, and the mandrel 14 extends upwardly through the profiled section 58 with the radially outwardly extending portions of the support surfaces 38 located adjacent the upper end of the profiled liner section 58.

As noted above, the presence of the elevated fluid pressure surrounding the cone 24 facilitates expansion of the liner 54, in that expansion is achieved by virtue of a combination of fluid pressure force and mechanical force, advantages of which are described in applicant's WO 02/081863, the disclosure of which is incorporated herein by reference.

On reaching a shoe 68 provided at the lower end of the liner 54, the ball 66 is lifted from its seat within the cone 18, such that a pressure drop is evident at surface, and the pumps are shut off.

The expanded liner 54 is now ready to be cemented in the bore. Accordingly, the running tool 64 is unlatched from the upper end of the liner 54 and translated through the expanded liner 54 to once again connect with the upper end of the expansion tool 10, as illustrated in FIG. 8, such that a "stinger" cementation may be carried out. Typically, this will involve pumping a pre-flush liquid through the drill pipe string 52 and tool string 50, which liquid will pass out of the lower end of the tool 10, flow through the liner shoe 68, pass up through the annulus between the expanded liner 54 and the surrounding open bore wall, pass up between the expanded profiled liner section 58 and the casing 56, and then pass up between the unexpanded section of liner 54 and the casing 56. A bottom cement dart is then dropped from surface, followed by a volume of cement and a top dart. Spacer fluid is then pumped into the string above the top dart such that the cement may be passed down through the string and circulated into the annulus, where the cement will set and seal the liner 54 in the bore.

After completion of the cementing operation the tool string 50 is raised to locate the rotary expansion tools 60, 62 within the lower end of the casing 56. Lifting the string causes the open cone 24 to close down, allowing the tool 10 to be withdrawn through the expanded liner 54. A ball is then dropped from surface and is caught in the upper end of the tool 10 such that the expansion tools 60, 62 may be actuated by pumping hydraulic fluid from surface.

The actuated expansion tools 60, 62 are then rotated and translated over a short distance to roll out expandable high pressure\temperature seals 72 provided on the upper end of the liner 54 and to roll out any unexpanded sections of liner 54.

The liner 54 also includes a weak notch profile which, when rolled out, causes the liner to separate, such that once the expansion tool 60, 62 are depressurized, the tool string 50 may be pulled back to surface, as shown in FIG. 9.

It will be apparent to those of skill in the art that the above described embodiment is merely exemplary of the present invention, and that various modifications and improvements may be made thereto, without departing from the scope of the invention. For example, in other embodiments of the invention the liner may be expanded after cement has been circulated into the surrounding annulus. Furthermore, rather than expanding the liner "top-down", it is possible to expand the liner "bottom-up". In this regard, the tool 10 offers a number of advantages, primarily that is may be possible to remove the closed tool 10 through a length of unexpanded liner, in contrast to conventional expansion cones. The translation of the cone may be achieved by a combination of pulling on the running string and applied hydraulic pressure behind the cone. Furthermore, in such an operation the liner may be cemented and expanded simultaneously.

In other embodiments of the invention a number of the features described above may be utilized separately of an expandable cone or expansion device. For example, the liner below the profiled liner section 58 need not necessarily be expanded, and the stinger cementation process may be usefully applied in setting or cementing operations where no expansion of tubing takes place.

The invention claimed is:

1. A tubing expansion tool, the tool comprising:

a mandrel defining at least one longitudinally curved support surface; and at least one expansion member defining a longitudinally curved bearing surface for contact with the support surface and corresponding to the mandrel support surface, the member being movable relative to the mandrel whereby the surfaces are in contact and movable over one another to move the expansion member from a smaller diameter first configuration towards a larger diameter second configuration, wherein at least a portion of the longitudinally curved support structure is in contact with a first portion of the longitudinally curved bearing surface in the smaller diameter first configuration and the portion of the longitudinally curved support structure is in contact with a second portion of the longitudinally curved bearing surface in the larger diameter second configuration.

2. The tool of claim 1, wherein at least one of the support surface and the bearing surface is arcuate.

3. The tool of claim 1, wherein the at least one support surface has a radius of curvature and the bearing surface of the at least one expansion member has a corresponding radius of curvature.

4. The tool of claim 1, wherein the support surface is convex and the bearing surface is concave.

5. The tool of claim 4, wherein the convex support surface is arranged such that the radial extent of the surface relative to the mandrel axis varies axially along the mandrel.

6. The tool of claim 1, wherein the mandrel defines a plurality of support surfaces, and a corresponding number of expansion members are provided, each defining a respective bearing surface.

7. The tool of claim 6, wherein the support surfaces are positioned circumferentially around the mandrel.

8. The tool of claim 7, wherein the support surfaces are tangential to the mandrel.

9. The tool of claim 6, wherein the support surfaces are of corresponding circumferential extent and are continuous around the circumference of the mandrel such that, in section, the mandrel has the appearance of a regular polygon.

10. The tool of claim 1, wherein a plurality of expansion members are provided and in the second configuration collectively define an expansion cone, each expansion member defining a cone segment.

11. The tool of claim 10, wherein the cone segments interlock.

12. The tool of claim 10, wherein the cone segments define a substantially continuous circumference in the larger diameter second configuration.

13. The tool of claim 1, wherein the expansion member is adapted to lock relative to the mandrel as the member moves from the first configuration to the second configuration.

14. The tool of claim 1, wherein an end of the expansion member is radially restrained relative to the mandrel.

15. The tool of claim 14, wherein a mounting ring is provided around the mandrel and the end of the member located in the ring.

16. The tool of claim 14, wherein the other end of the expansion member is restrained by a further restraining member, to prevent the member moving radially beyond the second configuration.

17. The tool of claim 1, further comprising at least one stop for preventing movement of the expansion member beyond the second configuration.

18. The tool of claim 17, wherein a stop is provided on the mandrel, for limiting axial movement of the expansion member.

19. The tool of claim 18, wherein the stop is movable from an initial at least partially retracted position to an extended position.

20. The tool of claim 19, wherein the stop is movable following an initial contact between the expansion member and the stop in an at least partially retracted position as the expansion member approaches the second configuration.

21. The tool of claim 1, wherein the expansion member is movable axially relative to the mandrel, and the support surface extends axially of the mandrel.

22. The tool of claim 21, further comprising means for initially restraining the expansion member against axial movement relative to the tubing.

23. The tool of claim 1, further including a seal member adapted to form a fluid seal with surrounding tubing.

24. The tool of claim 23, wherein the seal member is coupled to the mandrel.

25. The tool of claim 23, wherein the seal member is in the form of a swab cup.

26. The tool of claim 1, wherein the tool includes a tubing treating portion.

27. The tool of claim 26, wherein the tubing treating portion is provided in combination with a seal member adapted to form a fluid seal with surrounding tubing.

28. The tool of claim 27, wherein the tubing treating portion is adapted to expand the tubing to a predetermined diameter, to match the seal member.

29. The tool of claim 28, wherein the tubing treating portion is adapted to provide a compliant expansion function.

30. The tool of claim 27, wherein the tubing treating portion is adapted to reform the tubing to a predetermined form, to match the seal member.

31. The tool of claim 26, wherein the tubing treating portion is spaced from the expansion member when the member is in the second configuration and thus acts to stabilize the expansion member.

32. The tool of claim 1, in combination with a stabilizing portion axially spaced from the expansion member when the member is in the second configuration.

33. The tool of claim 1, wherein the support surface and bearing surface are initially spaced apart, such that a degree of relative movement between the mandrel and the expansion member is required before the expansion member begins to move towards the second configuration.

34. The tool of claim 1, wherein an arcuate surface extends between the first portion and the second portion.

35. The tool of claim 1, wherein the portion of the longitudinally curved support structure extends over a length of the longitudinally curved bearing surface.

36. A method of expanding tubing, the method comprising:

coupling a length of tubing to a running tool;

locating a tubing expansion cone in a smaller diameter first configuration within the length of tubing having an inner diameter;

coupling the tubing expansion cone to the running tool and running the cone into a bore;

applying a pressure thereby moving the cone to a larger diameter second configuration in which the cone describes an external diameter larger than the tubing inner diameter;

expanding a section of the tubing by simultaneously utilizing the cone and the pressure; and releasing the tubing from the running tool.

37. The method of claim 36, wherein the cone is moved to the larger diameter second configuration within the tubing such that a portion of tubing surrounding the cone experiences diametric expansion.

38. The method of claim 37, further comprising expanding another portion of the length of tubing.

39. The method of claim 38, further comprising expanding said other portion of the length of tubing prior to expanding the tubing with the cone.

40. The method of claim 38, further comprising expanding a profiled section of the length of tubing.

41. The method of claim 40, further comprising expanding the profiled section of tubing with an expansion tool and then moving the cone to the larger diameter second configuration using said expansion tool.

42. The method of claim 38, further comprising locating said expanded other portion of the length of tubing within another length of tubing, said expanded other portion of the length of tubing having an outer diameter larger than an inner diameter of said other length of tubing, such that at least one length of tubing is deformed to create a coupling between said lengths of tubing.

43. The method of claim 36, wherein the tubing is expanded in a well bore.

44. The method of claim 43, wherein the tubing is liner.

45. The method of claim 43, wherein the cone is located in the length of tubing on surface and then run into the well bore with the tubing.

46. The method of claim 36, wherein the portion of the length of tubing which accommodates the cone has an outer diameter substantially similar to the remainder of the length of tubing.

47. The method of claim 36, wherein the tubing expansion cone comprises at least one axially extending expansion member movable between first and second configurations corresponding to the first and second cone configurations, and wherein the expansion member is supported over a substantial axially extending portion as the member moves from the first configuration towards the second configuration.

48. The method of claim 36, further comprising axially translating the cone in the second configuration through at least a portion of the length of tubing to diametrically expand said portion of tubing.

49. The method of claim 48, further comprising initially restraining the cone against axial movement relative to the tubing.

50. The method of claim 36, further comprising providing a tubing contacting member coupled to and axially spaced from the cone, and contacting an inner wall of the tubing with said tubing contacting member to stabilize the cone.

51. The method of claim 36, further comprising creating a pressure differential in the tubing across a portion of a tool operatively associated with the cone.

52. The method of claim 36, further comprising expanding the length of tubing to a predetermined diameter ahead of the cone.

53. The method of claim 36, further comprising stabilizing the tubing expansion cone relative to the tubing.

54. The method of claim 36, wherein the pressure is applied across a wall of the tubing.

55. The method of claim 36, further comprising moving the cone from the first configuration to the second configuration while applying the pressure across a wall of the tubing.

56. The method of claim 36, further comprising moving the cone from the second configuration to the first configuration.

57. The method of claim 36, further comprising delivering fluid from surface via the running tool and the cone.

58. The method of claim 57, wherein the fluid is a sealant.

59. The method of claim 58, wherein the sealant is cement.

60. The method of claim 36, further comprising pulling the running tool and cone out of a bore.

61. A method of expanding tubing, the method comprising:

coupling a tubing expansion cone to a running tool and running the tubing expansion cone into a length of tubing in a bore, wherein the length of tubing includes an inner diameter;

releasing the tubing expansion cone from the running tool in the length of tubing, wherein the tubing expansion cone is initially in a smaller diameter first configuration within the length of tubing;

moving the cone and tubing from a first location to a second location;

applying a fluid pressure thereby reconfiguring the cone in a larger diameter second configuration in which the cone describes an external diameter larger than the tubing inner diameter;

moving the cone through the tubing; and expanding a section of the tubing by simultaneously utilizing the cone and the fluid pressure applied to an inner surface of the section of tubing.

62. The method of claim 61, further comprising at least partially removing the cone from the tubing.

63. An expandable tubing assembly comprising:

a length of tubing having an inner diameter; and a tubing expansion tool having a mandrel defining at least one longitudinally curved support surface and a cone defining a longitudinally curved bearing surface for contact with the support surface and corresponding to the mandrel support surface, the cone initially in a smaller diameter first configuration, located within the length of tubing, the cone having a seal member for providing a sealing contact with the tubing, the cone being movable to a larger diameter second configuration within the tubing upon application of a pressure, wherein at least a portion of the longitudinally curved support structure is in contact with a first portion of the longitudinally curved bearing surface in the smaller diameter first configuration and the portion of the longitudinally curved support structure is in contact with a second portion of the longitudinally curved bearing surface in the larger diameter second configuration.

64. A method of expanding tubing downhole utilizing an expansion cone, the method comprising:

coupling an expansion cone to a running tool;

coupling the running tool to a length of tubing, wherein the running tool is configured to provide a seal against an inner wall of the length of tubing;

running the tubing into a bore with the running tool and the cone;

releasing the cone from the running tool in the bore and expanding at least a portion of the length of tubing;

providing a further expansion member and expanding another portion of the length of tubing using said further expansion member, wherein said other portion of tubing comprises a profiled section of tubing.

65. The method of claim 64, further comprising releasing the tubing from the running tool.

66. The method of claim 65, further comprising releasing the expanded tubing from the running tool.

67. The method of claim 65, further comprising pulling the running tool and cone out of the bore.

68. The method of claim 64, further comprising locating an expanded portion of tubing within another length of tubing, said expanded portion of tubing having an outer diameter larger than an inner diameter of said other length of tubing, such that at least one length of tubing is deformed to create a coupling between said lengths of tubing.

69. A method of locating first tubing relative to second tubing, the method comprising:

providing a first tubing having an outer diameter;

providing a second tubing, the second tubing having an inner diameter greater than said first tubing outer diameter;

running the first tubing through the second tubing, wherein a first portion of the first tubing comprises a crinkled wall profiled section of tubing;

expanding said first portion of the first tubing outside of the second tubing to an outer diameter greater than said second tubing inner diameter; and locating said expanded first portion within the second tubing to promote an interference fit therebetween.

70. The method of claim 69, wherein said second portion of the first tubing extends into an unlined section of a drilled bore.

71. The method of claim 70, further comprising passing fluid into an annulus between the first tubing and a wall of the bore.

72. A tubing expansion tool comprising:

an expansion member;

a stabilizing member axially spaced from the expansion member, wherein the stabilizing member is in the form of a compliant cone; and a seal member adapted to form a fluid seal with a surrounding tubing, wherein the seal member is disposed between the expansion member and the stabilizing member.

73. The tool of claim 72, wherein the stabilizing member is adapted to engage an inner wall of tubing to be expanded by the expansion member.

74. A method of expanding tubing, the method comprising:

coupling a length of tubing to a running tool;

locating a tubing expansion device in a smaller diameter first configuration within the length of tubing having an inner diameter;

coupling the tubing expansion device to the running tool and running the tubing expansion device into a bore;

forming a fluid seal with the length of tubing;

applying a differential pressure across a wall of the tubing thereby expanding a section of tubing adjacent the expansion device;

moving the device to a larger diameter second configuration in which the device describes an expansion diameter larger than the tubing inner diameter by utilizing the differential pressure; and releasing the length of tubing from the running tool.

75. A method of expanding tubing in a bore, the method comprising:

running an expansion device and a running tool into a bore;

releasing the expansion device from the running tool in the bore;

translating the expansion device relative to tubing in the bore after the expansion device is released from the running tool, wherein the running tool is configured to provide a seal against an inner wall of the tubing; and delivering fluid from surface via the running tool and the expansion device, wherein the fluid is a sealant.

76. The method of claim 75, further comprising reforming the tubing with the expansion device.

77. The method of claim 75, further comprising diametrically expanding the tubing with the expansion device.

78. The method of claim 75, further comprising running tubing into the bore.

79. The method of claim 78, further comprising running tubing into the bore with the expansion device and the running tool.

80. The method of claim 75, further comprising re-coupling the expansion device with the running tool in the bore.

81. The method of claim 75, further comprising coupling the tubing to the running tool.

82. The method of claim 81, further comprising releasing the tubing from the running tool.

83. The method of claim 75, wherein the sealant is cement.

84. The method of claim 75, further comprising pulling the running tool and expansion device out of a bore.

85. A method of expanding a tubular, the method comprising:

coupling the tubular to a running tool;

locating an expansion device in a smaller diameter first configuration within the tubular having an inner diameter;

coupling the expansion device to the running tool and running the expansion device into a bore;

forming a fluid seal with an inner surface of the tubular proximate the expansion device;

creating a fluid pressure differential across the fluid seal, whereby the fluid pressure differential is used to expand a section of tubing adjacent the expansion device;

moving the expansion device to a larger diameter second configuration in which the device describes an expansion diameter larger than the tubular inner diameter by utilizing the fluid pressure differential;

translating the expansion device relative to the tubular and expanding the tubular; and releasing the tubular from the running tool.

86. The method of claim 85, further comprising reforming the tubular with the expansion device.

87. The method of claim 85, wherein a force acting on the fluid seal is used in part to translate the expansion device relative to the tubular.

88. A method of expanding tubing, the method comprising:

locating a tubing expansion cone in a smaller diameter first configuration within a length of tubing having an inner diameter;

moving the cone to a larger diameter second configuration in which the cone describes an external diameter larger than the tubing inner diameter;

cleaning an inner surface of the tubing ahead of the cone; and expanding a section of the tubing by simultaneously utilizing the cone and an elevated fluid pressure applied to an inner surface of the section of tubing.

89. A method of expanding tubing, the method comprising:

coupling a tubing expansion cone to a running tool and running the cone into a length of tubing in a bore;

locating the tubing expansion cone in a smaller diameter first configuration within the length of tubing having an inner diameter;

releasing the cone from the running tool in the bore;

applying a pressure thereby moving the cone to a larger diameter second configuration in which the cone describes an external diameter larger than the tubing inner diameter; and expanding a section of the tubing by simultaneously utilizing the cone and the pressure.

90. The method of claim 89, further comprising re-coupling the cone with the running tool in the bore.

91. A method of expanding tubing downhole utilizing an expansion cone, the method comprising:

coupling an expansion cone to a running tool;

coupling the running tool to a length of tubing, wherein the running tool is configured to provide a seal against an inner wall of the length of tubing;

running the tubing into a bore with the running tool and the cone;

releasing the cone from the running tool in the bore and expanding at least a portion of the length of tubing;

re-coupling the cone with the running tool in the bore; and delivering fluid from a surface via the re-coupled running tool and cone, wherein the fluid is a sealant.

92. The method of claim 91, wherein the sealant is cement.

93. A method of expanding tubing downhole utilizing an expansion cone, the method comprising:

coupling an expansion cone to a running tool;

coupling the running tool to a length of tubing, wherein the running tool is configured to provide a seal against an inner wall of the length of tubing;

running the tubing into a bore with the running tool and the cone;

releasing the cone from the running tool in the bore and expanding at least a portion of the length of tubing;

providing a further expansion member and expanding another portion of the length of tubing using said further expansion member; and expanding said other portion of the length of tubing prior to expanding the tubing with the cone.

* * * * *